US008530400B2

(12) United States Patent
Seki et al.

(10) Patent No.: US 8,530,400 B2
(45) Date of Patent: Sep. 10, 2013

(54) MAINTENANCE LIQUID FOR INKJET PRINTERS

(75) Inventors: Eriko Seki, Tokyo (JP); Seiji Aida, Tokyo (JP); Yasuo Yoshihiro, Tokyo (JP); Kaori Nakano, Tokyo (JP); Ken Yamasaki, Tokyo (JP)

(73) Assignee: Toyo Ink Mfg. Co., Ltd., Tokyo (JP)

( * ) Notice: Subject to any disclaimer, the term of this patent is extended or adjusted under 35 U.S.C. 154(b) by 752 days.

(21) Appl. No.: 12/597,397

(22) PCT Filed: Apr. 25, 2008

(86) PCT No.: PCT/JP2008/058063

§ 371 (c)(1),
(2), (4) Date: Oct. 23, 2009

(87) PCT Pub. No.: WO2008/133326

PCT Pub. Date: Nov. 6, 2008

(65) Prior Publication Data

US 2010/0126529 A1 May 27, 2010

(30) Foreign Application Priority Data

Apr. 25, 2007 (JP) ..... 2007-115781

(51) Int. Cl.
*C11D 3/20* (2006.01)
*C11D 3/43* (2006.01)
*C11D 3/44* (2006.01)

(52) U.S. Cl.
USPC ..... 510/166; 510/499; 510/500; 510/505; 510/506; 134/38; 134/42

(58) Field of Classification Search
USPC ..... 510/166, 499, 500, 505, 506; 134/38, 134/42
See application file for complete search history.

(56) References Cited

U.S. PATENT DOCUMENTS

| | | | | |
|---|---|---|---|---|
| 4,501,680 | A * | 2/1985 | Aszman et al. | 510/238 |
| 4,865,758 | A * | 9/1989 | Caster et al. | 134/38 |
| 5,102,573 | A * | 4/1992 | Han et al. | 134/19 |
| 5,290,472 | A * | 3/1994 | Michael | 510/217 |
| 2002/0010115 | A1 | 1/2002 | Yano et al. | |
| 2003/0083220 | A1 * | 5/2003 | Doyel et al. | 510/412 |
| 2005/0018023 | A1 | 1/2005 | Momose et al. | |
| 2006/0014660 | A1 * | 1/2006 | McCartney | 510/421 |
| 2007/0076043 | A1 | 4/2007 | Aoyama et al. | |
| 2007/0099816 | A1 * | 5/2007 | Scheuing et al. | 510/475 |
| 2007/0132807 | A1 * | 6/2007 | Ota | 347/22 |
| 2007/0167343 | A1 * | 7/2007 | Suzuki et al. | 510/329 |
| 2007/0185004 | A1 * | 8/2007 | Kilkenny et al. | 510/475 |
| 2007/0225185 | A1 | 9/2007 | Kasai | |
| 2010/0062962 | A1 | 3/2010 | Momose et al. | |

FOREIGN PATENT DOCUMENTS

| | | |
|---|---|---|
| JP | 59 111856 | 6/1984 |
| JP | 62 9030 | 2/1987 |
| JP | 8 1953 | 1/1996 |
| JP | 8 67839 | 3/1996 |
| JP | 9-29985 | 2/1997 |
| JP | 11 152499 | 6/1999 |
| JP | 2004 182875 | 7/2004 |
| JP | 2005 120389 | 5/2005 |
| JP | 2006 291191 | 10/2006 |
| JP | 2007 110658 | 5/2007 |
| JP | 2007 253401 | 10/2007 |

OTHER PUBLICATIONS

EPA—United States Environmental Protection Agency, 5.2—"Dissolved Oxygen and Biochemical Oxygen Demand".*
Lenntech, "Why oxygen dissloved in water is important".*
Kutty, Chemical Features of Water, Dissolved Oxygen, chap. 4, Mar. 1987.*
Meck, "Dissolved Oxygen", Koi Club of San Diego, 1996.*

* cited by examiner

*Primary Examiner* — Gregory Delcotto
(74) *Attorney, Agent, or Firm* — Oblon, Spivak, McClelland, Maier & Neustadt, L.L.P.

(57) ABSTRACT

Provided is a maintenance liquid for inkjet printers, which comprises at least one of glycol ethers and glycol esters represented by the following general formulas (1) to (3), and 45 to 10 mg/L of dissolved oxygen:

$R_1CO(OR_2)_xOR_3$ General formula (1)

$R_4CO(OR_5)_YOCOR_6$ General formula (2)

$R_7(OR_8)_ZOR_9$ General formula (3)

wherein $R_2$, $R_5$, and $R_8$ each independently represent an ethylene group or a propylene group, $R_1$, $R_3$, $R_4$, and $R_6$ each independently represent an alkyl group having 1 to 4 carbon atoms, $R_7$ and $R_9$ each independently represent a hydrogen atom or an alkyl group having 1 to 4 carbon atoms, and X, Y, and Z each independently represent an integer of 1 to 4.

10 Claims, No Drawings

MAINTENANCE LIQUID FOR INKJET PRINTERS

TECHNICAL FIELD

The present invention relates to a maintenance liquid for inkjet printers and a method for cleaning an inkjet printer using the same.

BACKGROUND ART

In recent years, an inkjet printer, which discharges ink from its head onto a recording medium to record a desired image on the recording medium, is widely used. Examples of an ink for use in such an inkjet printer include wax inks which are solid at ambient temperature, solvent inks mainly containing an aqueous solvent or an organic solvent, and photo-curable inks which are cured by exposure to light.

Since such an inkjet printer discharges ink through discharge ports with a very small diameter provided in a head, there is a possibility that the ink adheres to the head, areas near the discharge ports, and other parts of the inkjet printer and the discharge ports become clogged with the dried and solidified ink. Therefore, various measures are taken to prevent clogging of discharge ports with ink.

Patent Document 1 discloses a technique for capping discharge ports while an inkjet printer does not perform image recording. However, if the printer is not used for a long period of time, the viscosity of ink near a recording head increases due to vaporization of a solvent so that clogging of the discharge ports is likely to occur. Further, clogging of the discharge ports with foreign matter such as dust in the air is also likely to occur. Such clogging of discharge ports becomes a cause of defective ink discharge.

Patent Documents 2 and 3 disclose a technique for wiping ink off areas near the discharge ports of an inkjet printer when the inkjet printer performs image recording or just before the end of image recording. However, the ink wiped off with a cleaning member adheres to the cleaning member by its surface tension, and therefore when wiped with such a cleaning member, the discharge-port surface is likely to get dirty. Further, there is also a problem that if the ink adhering to the cleaning member is solidified and then enters the discharge ports, the solidified ink causes defective ink discharge.

Patent Document 3 also discloses a technique for wiping ink off discharge ports using silicone oil or ethylene glycol as a cleaner. Patent Document 4 discloses a cleaner for removing an ink for electronic parts which contains a monomer component and a polyhydric alcohol or its derivative. Patent Document 5 discloses a cleaner containing glycol ethers as a main component, water, surfactants, and at least one other aqueous organic solvent as an additional components. Such a cleaner has a high ability to dissolve ink due to its additional component. However, if the additional component remains after cleaning, the remaining additional component slows down the evaporation of the cleaner or deteriorates the stability of ink supplied to a printer after cleaning.

Patent Document 6 discloses a cleaner for use in cleaning ink supply parts such as ink bottles and ink supply rollers and various printing plates such as screen printing plates and gravure printing plates which are used in printing processes of gravure printing, flexographic printing, offset printing, and the like.

However, those cleaners are intended to remove or peel off ink from substrates on which it has been printed or applied.

Under the circumstances, there has been a demand for a maintenance liquid for inkjet printers which offers excellent cleaning performance but does not soil an inkjet head member for inkjet ink, does not cause non-discharge of ink, and does not corrode inkjet printer components.

Patent Document 1: JP-A-59-111856
Patent Document 2: JP-A-8-1953
Patent Document 3: JP-B-62-9030
Patent Document 4: JP-A-2006-291191
Patent Document 5: JP-A-8-67839
Patent Document 6: JP-A-2005-120389

DISCLOSURE OF THE INVENTION

One aspect of the present invention relates to a maintenance liquid for inkjet printers, containing at least one of glycol ethers and glycol esters represented by the following general formulas (1) to (3) and containing 45 to 10 mg/L of dissolved oxygen:

$$R_1CO(OR_2)_xOR_3 \qquad \text{General formula (1)}$$

$$R_4CO(OR_5)_YOCOR_6 \qquad \text{General formula (2)}$$

$$R_7(OR_8)_ZOR_9 \qquad \text{General formula (3)}$$

wherein $R_2$, $R_5$, and $R_8$ each independently represent an ethylene group or a propylene group, $R_1$, $R_3$, $R_4$, and $R_6$ each independently represent an alkyl group having 1 to 4 carbon atoms, $R_7$ and $R_9$ each independently represent a hydrogen atom or an alkyl group having 1 to 4 carbon atoms, and X, Y, and Z each independently represent an integer of 1 to 4.

The maintenance liquid may be used for either an inkjet printer that performs printing using an ink mainly containing an organic solvent having a boiling point of 150° C. or higher or an inkjet printer that performs printing using an ink mainly containing a UV-curable monomer, a UV-curable oligomer, or the like.

The total amount of the at least one of glycol ethers and glycol esters represented by the general formulas (1) to (3) contained in the maintenance liquid may be 80 wt % or more.

The maintenance liquid may further contain a cyclic compound. Examples of the cyclic compound include cyclic ether-based solvents, cyclic ester-based solvents, cyclic amide-based solvents, cyclic ketone-based solvents, N-alkyl-oxazolidinone-based solvents, and N-alkyl-2-pyrrolidone.

In a case where the maintenance liquid contains the cyclic compound, the mixing ratio between the at least one of glycol ethers and glycol esters represented by the general formulas (1) to (3) and the cyclic compound may be 80 to 100:20 to 0 parts by weight.

The maintenance liquid may contain 1 to 20 wt % of N-alkyl-oxazolidinone as the cyclic compound.

The maintenance liquid may be obtained after adjusting the amount of dissolved oxygen contained therein.

Another aspect of the present invention relates to a method for cleaning an inkjet printer, including cleaning an inkjet printer using the maintenance liquid according to the present invention.

According to an aspect of the present invention, it is possible to efficiently clean an apparatus or printer components such as a head soiled by an ink composition having adhered thereto by printing using an inkjet ink without corroding it/them. Further, according to an aspect of the present invention, it is also possible to stably eject ink after cleaning of printer components.

The present disclosure relates to the subject matter of Japanese Patent Application No. 2007-115781 (filed on Apr. 25, 2007), the entire disclosure of which is incorporated herein by reference.

BEST MODE FOR CARRYING OUT THE INVENTION

Embodiments of the present invention will be described in detail.

A maintenance liquid for inkjet printers (hereinafter, simply referred to as a "maintenance liquid") according to the present invention contains at least one of glycol ethers and glycol esters represented by the following general formulas (1) to (3):

$$R_1CO(OR_2)_xOR_3 \quad \text{General formula (1)}$$

$$R_4CO(OR_5)_YOCOR_6 \quad \text{General formula (2)}$$

$$R_7(OR_8)_ZOR_9 \quad \text{General formula (3)}$$

wherein $R_2$, $R_5$, and $R_8$ each independently represent an ethylene group or a propylene group, $R_1$, $R_3$, $R_4$, and $R_6$ each independently represent an alkyl group having 1 to 4 carbon atoms, $R_7$ and $R_9$ each independently represent a hydrogen atom or an alkyl group having 1 to 4 carbon atoms, and X, Y, and Z each independently represent an integer of 1 to 4.

Examples of a solvent represented by the general formula (1) include, but are not limited to, glycol monoacetates such as ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, ethylene glycol monomethyl ether propionate, ethylene glycol monoethyl ether propionate, ethylene glycol monobutyl ether propionate, diethylene glycol monomethyl ether propionate, diethylene glycol monoethyl ether propionate, diethylene glycol monobutyl ether propionate, propylene glycol monomethyl ether propionate, dipropylene glycol monomethyl ether propionate, ethylene glycol monomethyl ether butylate, ethylene glycol monoethyl ether butylate, ethylene glycol monobutyl ether butylate, diethylene glycol monomethyl ether butylate, diethylene glycol monoethyl ether butylate, diethylene glycol monobutyl ether butylate, propylene glycol monomethyl ether butylate, and dipropylene glycol monomethyl ether butylate. Among them, ethylene glycol monobutyl ether acetate and diethylene glycol monoethyl ether acetate are preferred because they have good compatibility with inks and printer components and a high boiling point.

Examples of a solvent represented by the general formula (2) include, but are not limited to, glycol diacetates such as ethylene glycol diacetate, diethylene glycol diacetate, propylene glycol diacetate, dipropylene glycol diacetate, ethylene glycol acetate propionate, ethylene glycol acetate butylate, ethylene glycol propionate butylate, ethylene glycol dipropionate, ethylene glycol acetate dibutylate, diethylene glycol acetate propionate, diethylene glycol acetate butylate, diethylene glycol propionate butylate, diethylene glycol dipropionate, diethylene glycol acetate dibutylate, propylene glycol acetate propionate, propylene glycol acetate butylate, propylene glycol propionate butylate, propylene glycol dipropionate, propylene glycol acetate dibutylate, dipropylene glycol acetate propionate, dipropylene glycol acetate butylate, dipropylene glycol propionate butylate, dipropylene glycol dipropionate, and dipropylene glycol acetate dibutylate. Among them, dipropylene glycol diacetate is preferred because it has good compatibility with inks and printer components and a high boiling point.

Examples of a solvent represented by the general formula (3) include, but are not limited to, glycols such as ethylene glycol, diethylene glycol, triethylene glycol, propylene glycol, and dipropylene glycol and glycol ethers such as ethylene glycol monobutyl ether, propylene glycol monomethyl ether, propylene glycol monobutyl ether, diethylene glycol monoethyl ether, diethylene glycol diethyl ether, diethylene glycol monobutyl ether, diethylene glycol dibutyl ether, diethylene glycol methyl ethyl ether, dipropylene glycol monomethyl ether, dipropylene glycol monoethyl ether, dipropylene glycol monobutyl ether, propylene glycol n-propyl ether, triethylene glycol monomethyl ether, triethylene glycol monoethyl ether, triethylene glycol monobutyl ether, tripropylene glycol monomethyl ether, tetraethylene glycol dimethyl ether, and tetraethylene glycol diethyl ether. Among them, diethylene glycol diethyl ether and tetraethylene glycol dimethyl ether are particularly preferred because they have good compatibility with inks and printer components and a high boiling point.

The above-mentioned solvents represented by the general formulas (1) to (3) may be used singly or in appropriate combination of two or more of them. Also from the viewpoint of safety, these solvents are preferred (Ordinance on Prevention of Organic Solvent Poisoning and PRTR (Pollutant Release and Transfer Register) do not apply to these solvents). The total amount of the glycol ethers and/or glycol esters represented by the general formulas (1) to (3) contained in the maintenance liquid according to the present invention is preferably 80 wt % or more, more preferably 90 to 99 wt %.

The maintenance liquid according to the present invention may further contain a cyclic compound. The maintenance liquid containing a cyclic compound can offer excellent cleaning performance because the cyclic compound has a high ability to dissolve components contained in an inkjet ink such as resins.

Examples of such a cyclic compound include, but are not limited to, cyclic ether-based solvents, cyclic ester-based solvents, cyclic amide-based solvents, cyclic ketone-based solvents, N-alkyl-oxazolidinone-based solvents, and N-alkyl-2-pyrrolidone. Among them, cyclic ester-based solvents, N-alkyl-oxazolidinone-based solvents, and N-alkyl-2-pyrrolidone are preferred from the viewpoints of odor and safety.

Examples of the cyclic ether-based solvents include, but are not limited to, dioxane, trioxane, furan, tetrahydrofuran, methyltetrahydrofuran, methylfuran, tetrahydropyran, furfural, tetrahydropyran-4-carboxylic acid methyl ester, and tetrahydropyran-4-carboxylic acid ethyl ester. Among them, tetrahydrofuran is preferred.

Examples of the cyclic ester-based solvents include, but are not limited to, β-lactones having a four-membered ring structure such as β-butyrolactone, γ-lactones having a five-membered ring structure such as γ-butyrolactone, γ-valerolactone, γ-hexylactone, γ-heptalactone, γ-octalactone, γ-nonalactone, γ-decalactone, and γ-undecalactone, δ-lactones having a six-membered ring structure such as δ-valerolactone, δ-hexylactone, δ-heptalactone, δ-octalactone, δ-nanolactone, δ-decalactone, and δ-undecalactone, and ϵ-lactones having a seven-membered ring structure such as ϵ-caprolactone. Among them, γ-butyrolactone is preferred.

Examples of the cyclic amide-based solvents include, but are not limited to, β-lactams having a four-membered ring structure such as β-butyrolactam, γ-lactams having a five-membered ring structure such as γ-butyrolactam, γ-valerolactam, γ-hexalactam, γ-heptalactam, γ-octalactam, γ-nonalactam, γ-decalactam, and γ-undecalactam, δ-lactams having a six-membered ring structure such as δ-valerolactam, δ-hexalactam, δ-heptalactam, δ-octalactam, δ-nonalactam, δ-decalactam, and δ-undecalactam, and ϵ-lactams having a seven-membered ring structure such as ε-caprolactam. Among them, γ-butyrolactam is preferred.

Examples of the cyclic ketone-based solvents include, but are not limited to, cyclopentanone, cyclohexanone, and cycloheptanone. Among them, cyclohexanone is preferred.

Examples of the N-alkyl-oxazolidinone-based solvents include, but are not limited to, 3-methyl-2-oxazolidinone, 3-ethyl-2-oxazolidinone, and 3-propyl-2-oxazolidinone. Among them, 3-methyl-2-oxazolidinone is preferred.

Examples of the N-alkyl-2-pyrrolidone include, but are not limited to, N-methyl-2-pyrrolidone, N-ethyl-2-pyrrolidone, N-propyl-2-pyrrolidone, and N-octyl-2-pyrrolidone. Among them, N-methyl-2-pyrrolidone is preferred.

In the case of using the cyclic compound, the mixing ratio between the at least one of glycol ethers and glycol esters represented by the general formulas (1) to (3) and the cyclic compound is preferably 80 to 100:20 to 0 parts by weight, more preferably 90 to 99:10 to 1 parts by weight. Particularly, in a case where the maintenance liquid contains N-alkyl-oxazolidinone as the cyclic compound, the amount of the N-alkyl-oxazolidinone is preferably 1 to 20 wt % with respect to the total amount of solvents used. If the total amount of the at least one of glycol ethers and glycol esters is less than 80 wt %, the total amount of other components, such as the cyclic compound, contained in the maintenance liquid is increased. Therefore, if these components stay for a long period of time or remain inside a printer, there is a possibility that discoloration and deterioration of printer components made of EPDM (ethylene propylene diene rubber) provided inside the printer occur, tubes for use as flow channels are damaged, or the stability of ink itself supplied to the printer is impaired.

The maintenance liquid according to the present invention may further contain additives usually used for inks such as a surfactant and an antifoaming agent.

The amount of dissolved oxygen contained in the maintenance liquid according to the present invention is set to a value within the range of 45 to 10 mg/L. From the viewpoint of simplifying the production of the maintenance liquid and etc., the amount of dissolved oxygen contained in the maintenance liquid is more preferably in the range of 40 to 25 mg/L. If the amount of dissolved oxygen contained in the maintenance liquid exceeds 45 mg/L, micro air bubbles are likely to be generated inside a printer when the printer components are cleaned with such a maintenance liquid. If ink discharge is performed after cleaning in a state where the micro air bubbles remain inside the printer, a pressure applied to ink is absorbed by the air bubbles so that the ink is not normally discharged. Particularly, in the case of using an ink mainly containing a UV-curable monomer, a UV-curable oligomer, or the like, if micro air bubbles derived from dissolved oxygen contained in the maintenance liquid are generated inside a printer, oxygen deactivating radical active species contained in the ink is mixed with the ink to be discharged, and therefore it becomes impossible to supply a sufficient amount of radicals required to initiate polymerization reaction of a polymerizable compound. As a result, the curing reaction of the inkjet recording ink is inadequately performed. On the other hand, if the amount of dissolved oxygen contained in the maintenance liquid is less than 10 mg/L, dissolved oxygen contained in an ink mainly containing a UV-curable monomer, a UV-curable oligomer, or the like is consumed when the maintenance liquid is mixed with such a UV-curable ink. As a result, the viscosity of the ink itself increases, and in the worst case, it can be considered that gelation of the ink occurs. In order to avoid such problems, the amount of dissolved oxygen contained in the maintenance liquid according to the present invention for use in the maintenance of printers is set to a value within the range of 45 mg/L to 10 mg/L. This makes it possible to prevent the instability of ejection properties caused by oxygen. In addition, it is also possible to, when an ink mainly containing a UV-curable monomer, a UV-curable oligomer, or the like is used, effectively prevent polymerization inhibition to maintain the stability of the ink.

Examples of a method for adjusting the concentration of dissolved oxygen include, but are not limited to, a method in which the maintenance liquid is deaerated under a reduced pressure, a method in which the maintenance liquid is deaerated by ultrasonic irradiation, and a method in which the maintenance liquid is deaerated using a hollow-fiber membrane. In this example, the concentration of dissolved oxygen in the maintenance liquid is adjusted by deaerating the maintenance liquid under a reduced pressure.

Further, the adjusted concentration of dissolved oxygen in the maintenance liquid can be controlled by removing air in all the containers for storing various solvents for use as raw materials of the maintenance liquid, tanks for use in producing the maintenance liquid, and containers for storing the finally-obtained maintenance liquid by purging with nitrogen.

Examples of a method for measuring the concentration of dissolved oxygen include, but are not limited to, the Ostwald method (see "The Series of Experimental Chemistry, Vol. 1, Basic Operation [1]", p. 241, 1975, Maruzen), a mass spectrometric method, a method using an oxygen meter, and a colorimetric assay method. The concentration of dissolved oxygen can be easily measured also by using a commercially-available dissolved oxygen concentration meter.

A method for cleaning an inkjet printer using the maintenance liquid according to the present invention will be described below. Examples of a method for cleaning an inkjet printer some parts thereof using the maintenance liquid according to the present invention include a method in which an inkjet printer or some parts thereof is/are wiped with a cloth or cleaning blade moistened with the maintenance liquid according to the present invention and a method in which an inkjet printer or some parts thereof is/are immersed in the maintenance liquid according to the present invention. In a case where an inkjet printer has a cleaning system for cleaning a head, the head can be cleaned by the cleaning system by supplying the maintenance liquid according to the present invention to the cleaning system. Alternatively, discharge ports of a head may be covered with a cap coated with the maintenance liquid according to the present invention. That is, the head may be immersed in the maintenance liquid to dissolve ink solidified around the discharge ports of the head to prevent clogging of nozzles.

When an inkjet printer is cleaned with the maintenance liquid according to the present invention, a very small amount of the maintenance liquid remains and adheres to a head, areas around discharge ports, and other parts of the inkjet printer. It is to be noted that a very small amount of the maintenance liquid remaining on the surface of an inkjet printer or parts thereof still remains even when it is absorbed by an absorbent or air is blown on the inkjet printer or some parts thereof.

In a case where an inkjet ink mainly contains an organic solvent, a very small amount of the remaining maintenance liquid redissolves a very small amount of the inkjet ink solidified by drying. This makes it possible to prevent the accumulation of the solidified inkjet ink on the head, thereby preventing non-discharge of ink from the head. On the other hand, in a case where an inkjet ink mainly contains a UV-curable monomer, a UV-curable oligomer, or the like, a very small amount of the maintenance liquid remaining on a head gives a non-curable component to the inkjet ink adhering to the head so that the curing of the UV-curable ink is inhibited. Therefore, the ink adhering to the head, areas near discharge ports, and other printer parts on which a small amount of the maintenance liquid remains can be easily removed by cleaning them with the cleaning liquid according to the present invention. Similarly, when the UV-curable ink which has not yet been cured by UV light is wiped off a head, areas around discharge ports, and other inkjet printer parts with, for example, a cloth moistened with the maintenance liquid according to the present invention, the maintenance liquid adheres to the head and various parts around the discharge ports. Therefore, even when the UV-curable ink adheres to the head and the various parts around the discharge ports, it is not cured.

Further, even when the maintenance liquid according to the present invention is kept in contact with flow channels provided inside a printer and components made of EPDM (ethylene propylene diene rubber) provided inside an inkjet head for a long period of time, discoloration and deterioration of the components and damage of tubes used as flow channels do not occur.

Examples of an ink for use in inkjet printers using the maintenance liquid according to the present invention include solvent inks mainly containing an organic solvent, photocurable inks mainly containing a monomer, an oligomer, or the like curable with active energy rays such as UV rays or radioactive rays, inks containing nano metal microparticles made of silver or gold for use in forming fine patterns such as conductive circuits, and inks for color filters. The maintenance liquid according to the present invention can offer excellent cleaning performance on all of these inks.

EXAMPLES

Hereinbelow, the present invention will be described in more detail with reference to the following examples, but these examples are not intended to limit the scope of the present invention. It is to be noted that in the following examples, "part(s)" refers to "part(s) by weight".

In the following examples and comparative examples, maintenance liquids were prepared. It is to be noted that in each of the following examples and comparative examples, containers for storing raw materials of the maintenance liquid, tanks for use in producing the maintenance liquid, and containers for storing the deaerated maintenance liquid were purged with nitrogen to prevent containing oxygen.

Examples 1 to 7

A maintenance liquid of the solvent composition shown in Table 1 was prepared.

Then, the maintenance liquid was placed in a plastic container, and the plastic container was further placed in a glass vacuum desiccator. Then, the internal pressure of the desiccator was reduced to 5 mmHg to adjust the amount of dissolved oxygen contained in the maintenance liquid to 30±2 mg/L. The amount of dissolved oxygen contained in the maintenance liquid was measured by using a commercially-available dissolved oxygen concentration meter UC-12-SOL (manufactured by Central Kagaku Corporation).

Example 8

A maintenance liquid of the solvent composition shown in Table 1 was prepared. Then, the maintenance liquid was deaerated under a reduced pressure and the amount of dissolved oxygen contained in the maintenance liquid was measured in the same manner as in Example 1 except that the amount of dissolved oxygen contained in the maintenance liquid was adjusted to 12±2 mg/L.

Example 9

A maintenance liquid of the solvent composition shown in Table 1 was prepared. Then, the maintenance liquid was deaerated under a reduced pressure and the amount of dissolved oxygen contained in the maintenance liquid was measured in the same manner as in Example 1 except that the amount of dissolved oxygen contained in the maintenance liquid was adjusted to 43±2 mg/L.

Comparative Examples 1 and 2

A maintenance liquid of the solvent composition shown in Table 2 was prepared. Then, the maintenance liquid was deaerated under a reduced pressure and the amount of dissolved oxygen contained in the maintenance liquid was measured in the same manner as in Example 1.

Comparative Examples 3 to 5

A maintenance liquid of the solvent composition shown in Table 2 was prepared. Then, the amount of dissolved oxygen contained in the maintenance liquid was measured in the same manner as in Example 1 except that the maintenance liquid was no deaerated.

Comparative Example 6

A maintenance liquid of the solvent composition shown in Table 2 was prepared. Then, the amount of dissolved oxygen contained in the maintenance liquid was measured in the same manner as in Example 1 except that the amount of dissolved oxygen contained in the maintenance liquid was adjusted to 8±2 mg/L.

Comparative Example 7

A maintenance liquid of the solvent composition shown in Table 2 was prepared. Then, the amount of dissolved oxygen contained in the maintenance liquid was measured in the same manner as in Example 1 except that deaeration time was controlled so that the amount of dissolved oxygen contained in the maintenance liquid was adjusted to 45±2 mg/L.

TABLE 1

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| diethylene glycol monobutyl ether acetate | 100.0 | | | | | | 92.5 | 100.0 | 100.0 |
| diethylene glycol monoethyl ether acetate | | 100.0 | | | | | | | |

TABLE 1-continued

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| ethylene glycol monobutyl ether acetate | | | 95.0 | 92.5 | | | | | |
| dipropylene glycol diacetate | | | | | 100.0 | | | | |
| diethylene glycol diethyl ether | | | | | | 85.5 | | | |
| tetraethylene glycol dimethyl ether | | | | | | 10.0 | | | |
| N-methyl-2-pyrrolidone | | | 5.0 | | | | | | |
| γ-butyrolactone | | | | 7.5 | | | 7.5 | | |
| methyl oxazolidinone | | | | | | 4.5 | | | |
| cyclohexanone | | | | | | | | | |
| benzyl alcohol | | | | | | | | | |
| nonionic surfactant (Emulgen 709 manufactured by Kao Corporation) | | | | | | | | | |
| water | | | | | | | | | |
| Total | 100.0 | 100.0 | 100.0 | 100.0 | 100.0 | 100.0 | 100.0 | 100.0 | 100.0 |
| Dissolved Oxygen Content (mg/L) | 30.9 | 29.5 | 31.0 | 30.4 | 30.4 | 32.0 | 31.6 | 12.2 | 43.9 |

TABLE 2

| | Com. Ex. 1 | Com. Ex. 2 | Com. Ex. 3 | Com. Ex. 4 | Com. Ex. 5 | Com. Ex. 6 | Com. Ex. 7 |
|---|---|---|---|---|---|---|---|
| diethylene glycol monobutyl ether acetate | | | 20.0 | | 100.0 | 100.0 | 100.0 |
| diethylene glycol monoethyl ether acetate | | | 70.0 | 90.0 | | | |
| ethylene glycol monobutyl ether acetate | | | | | | | |
| dipropylene glycol diacetate | | | | | | | |
| diethylene glycol diethyl ether | | | | | | | |
| tetraethylene glycol dimethyl ether | | | | | | | |
| N-methyl-2-pyrrolidone | | | | | | | |
| γ-butyrolactone | | | | | | | |
| methyl oxazolidinone | | | | | | | |
| cyclohexanone | 100.0 | | | | | | |
| benzyl alcohol | | 100.0 | | | | | |
| nonionic surfactant (Emulgen 709 manufactured by Kao Corporation) | | | | 10.0 | | | |
| water | | | 10.0 | | | | |
| Total | 100.0 | 100.0 | 100.0 | 100.0 | 100.0 | 100.0 | 100.0 |
| Dissolved Oxygen Content (mg/L) | 35.6 | 39.3 | 54.0 | 52.6 | 55.8 | 8.2 | 46.5 |

Inks for inkjet printers for use in evaluation were prepared in the following manner.

(Solvent-Type Ink)

As an ink mainly containing an organic solvent having a boiling point of 150° C. or higher, "EG-Outdoor Ink" for Color Painter 64S Plus (solvent ink inkjet printer) manufactured by Seiko I Infotech Inc. was used.

(UV-Curable Ink)

An ink mainly containing a UV-curable monomer, a UV-curable oligomer, or the like was prepared in the following manner.

First, a pigment dispersion A of the following composition was prepared by adding a pigment and a dispersant to an organic solvent, stirring them by, for example, a high-speed mixer to obtain a homogeneous mill base, and dispersing the mill base by a horizontal sand mill for about 1 hour.

LIONOL BLUE FG-7400G (phthalocyanine pigment manufactured by TOYO INK MFG CO., LTD.): 30.0 parts SOLSPERSE 32000 (pigment dispersant manufactured by Avecia): 9.0 parts 2-phenoxyethyl acrylate: 61.0 parts Then, an inkjet ink was prepared using the above pigment dispersion A according to the following formula.

pigment dispersion A: 11.4 parts 2-phenoxyethyl acrylate: 40.0 parts

BYK-361N (acrylic resin manufactured by BYK Chemie): 0.1 part

N-vinylcaprolactam: 15.0 parts ethoxylated trimethylolpropane triacrylate: 20.0 parts Ebecryl 8402 (difunctional urethane oligomer manufactured by Daicel-UCB Co., Ltd.): 5.5 parts IRGACURE 907 (photo-radical polymerization initiator manufactured by Ciba Specialty Chemicals): 4.0 parts IRGACURE 819 (photo-radical polymerization initiator manufactured by Ciba Specialty Chemicals): 4.0 parts The maintenance liquids obtained in Examples and Comparative Examples were evaluated in the following manner.

(Evaluation of Cleaning Performance of Maintenance Liquid (1))

0.05 g of the solvent-type ink was weighed and placed in a metal container, and was then dried in an oven at 70° C. for 2 hours. Then, 1.0 g of the maintenance liquid was added to the dried ink, and they were homogeneously mixed. At this time, the time required to completely redissolve the dried ink was measured with a stop-watch. This test was repeated five times in the same manner, and the average of five measurements was defined as average time. The average time is shown in Table 3.

○: The time required to completely dissolve the dried ink was shorter than 4 minutes.

Δ: The time required to completely dissolve the dried ink was 4 minutes or longer but shorter than 9 minutes.

x: The time required to completely dissolve the dried ink was 10 minutes or longer or the dried ink was not dissolved.

(Evaluation of Cleaning Performance of Maintenance Liquid (2))

The solvent-type ink was charged into a solvent ink inkjet printer (Color Painter 64S Plus manufactured by Seiko I Infotech Co., Ltd.), the maintenance liquid was supplied to a maintenance liquid tank, and the inkjet printer was operated. The ink was discharged from a printer head onto a recording medium to perform image recording for 8 hours every day for one month. During that time, the printer was cleaned by a cleaning system thereof every week. After one-month continuous operation of the printer, discharge ports of the head were visually observed to evaluate the presence or absence of clogging of the discharge ports of the head. Further, the frequency of the occurrence of dot loss, flight deflection, or ink scattering in printed matter was determined. It is to be noted that in this specification, the term "flight deflection" means a phenomenon in which a dot is formed apart from its target position by a distance corresponding to the diameter of a single dot or longer.

○: The frequency of the occurrence of dot loss, flight deflection, or ink scattering after the one-month continuous printing test and cleaning was less than 10 times.

Δ: The frequency of the occurrence of dot loss, flight deflection, or ink scattering after the one-month continuous printing test and cleaning was 10 times or more but less than 20 times.

x: The frequency of the occurrence of dot loss, flight deflection, or ink scattering after the one-month continuous printing test and cleaning was 20 times or more.

(Evaluation of Cleaning Performance of Maintenance Liquid (3))

The UV-curable ink was charged into an ink tank of a UV inkjet printer ("IJII 1800 UV Flatbet" manufactured by FLORA) having a piezo head, the maintenance liquid was supplied to a maintenance liquid tank, and the inkjet printer was operated. The UV-curable ink was discharged from discharge ports of the head of the printer to perform continuous recording onto a recording medium for 90 minutes. The head was cleaned after every 90-minute recording. The cleaning of the head was performed by turning a valve of the maintenance liquid tank to allow the maintenance liquid to flow through a tube connected to the tank once with the use of a pump and further softly wiping the head once with a cloth ("TechnoWipe C100-M" manufacture by Nippon Paper Crecia Co., Ltd.) wetted with 2 mL of the maintenance liquid. After the printer was continuously operated for 30 hours, the discharge ports of the head were visually observed to evaluate the presence or absence of clogging of the discharge ports of the head with the cured ink. Further, the frequency of the occurrence of dot loss, flight deflection, or ink scattering in printed matter was determined.

○: The frequency of the occurrence of dot loss, flight deflection, or ink scattering after the 30-hour continuous printing test and cleaning was less than 10 times.

Δ: The frequency of the occurrence of dot loss, flight deflection, or ink scattering after the 30-hour continuous printing test and cleaning was 10 times or more but less than 20 times.

x: The frequency of the occurrence of dot loss, flight deflection, or ink scattering after the 30-hour continuous printing test and cleaning was 20 times or more.

(Evaluation of Ejection Properties)

Ejection properties after cleaning with the maintenance liquid were evaluated in the following manner.

The maintenance liquid was supplied to a flow channel of each of the inkjet ink printers described above containing the solvent-type ink or the UV-curable ink to purge the ink from the flow channel of the printer with the maintenance liquid for cleaning. After the completion of cleaning, the ink was again charged into the printer, and the printer was operated. Just after charging the ink into the printer, recording using the ink was performed to determine the frequency of the occurrence of dot loss, flight deflection, or ink scattering in the resulting printed matter.

○: The frequency of the occurrence of dot loss, flight deflection, or ink scattering just after charging of the ink into the cleaned printer was less than 10 times in total.

Δ: The frequency of the occurrence of dot loss, flight deflection, or ink scattering just after charging of the ink into the cleaned printer was 10 times or more but less than 20 times in total.

x: The frequency of the occurrence of dot loss, flight deflection, or ink scattering just after charging of the ink into the cleaned printer was 20 times or more in total.

(Evaluation of Material Compatibility)

A head member of a printer and a tube for use as a flow channel were immersed in each of the maintenance liquids of Examples and Comparative Examples at 60° C. for 1 week. Then, the appearance of the head member and the tube was visually observed and evaluated. Further, a change in the size or weight of the head member and the tube was also evaluated.

○: No change was observed in the appearance of the head member and the tube even after immersion in the maintenance liquid, and the rate of change in size or weight before and after immersion was less than 2%.

Δ: A slight change was observed in the appearance of one or both of the head member and the tube after immersion in the maintenance liquid, and the rate of change in size or weight before and after immersion was 2% or higher but less than 10%.

x: One or both of the head member and the tube was/were discolored or melted by immersion in the maintenance liquid, and the rate of change in size or weight before and after immersion was 10% or higher.

(Change in State of Mixture)

In the early stage of cleaning, a small amount of cleaner is added to a large amount of remaining ink. Therefore, the stability of a mixture of a large amount of ink and a small amount of cleaner was evaluated. More specifically, 100 mL of the solvent-type ink or the UV-curable ink was prepared, and 2 mL of the maintenance liquid obtained in each of Examples and Comparative Examples was added to the ink under gentle stirring, a change in the viscosity of the solvent-type ink or the UV-curable ink before and after the addition of the maintenance liquid was measured and visually observed.

The viscosity of the inks and the mixtures was measured using an E-type viscometer (manufactured by TOKI SANGYO Co., Ltd.), and the average rate of change in viscosity was evaluated according to the following criteria.

If any change was observed in at least one of the mixture of the solvent-type ink and the maintenance liquid and the mixture of the UV-curable ink and the maintenance liquid, it was so noted in Table 3 or 4.

◎: The average rate of change in viscosity was less than 5%.

○: The average rate of change in viscosity was 5% or higher but less than 10%.

Δ: The average rate of change in viscosity was 10% or higher but less than 15%.

x: The average rate of change in viscosity was 15% or higher.

(Evaluation of Ejection Properties of Mixture)

When an ink is charged into a flow channel of a printer after cleaning, a small amount of cleaner is added to a large amount of the maintenance liquid in the early stage of ink charging. Therefore, the stability of a mixture of a small amount of ink and a large amount of the maintenance liquid was observed by performing an ejection test. More specifically, 2 mL of the solvent-type ink or the UV-curable ink was added to 100 mL of the maintenance liquid obtained in each of Examples and Comparative Examples under gentle stirring to prepare a mixture of the ink and the maintenance liquid. Then, the ejection properties of the mixture were evaluated in the same manner as described in the above "Evaluation of Ejection Properties".

The results of the above evaluation tests are shown in Tables 3 and 4.

TABLE 3

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Evaluation of Cleaning Performance (1) | ○ | ○ | ○ | ○ | ○ | ○ | ○ | ○ | ○ |
| Evaluation of Cleaning Performance (1) (unit: sec) | 3.62 | 3.81 | 2.77 | 2.96 | 3.22 | 2.85 | 3.00 | 3.65 | 3.60 |
| Evaluation of Cleaning Performance (2) Clogging | Non | Non | Non | Non | Non | Non | Non | Non | Non |
| Evaluation of Cleaning Performance (2) Flight Deflection etc. | ○ | ○ | ○ | ○ | ○ | ○ | ○ | ○ | ○ |
| Evaluation of Cleaning Performance (3) Clogging | Non | Non | Non | Non | Non | Non | Non | Non | Non |
| Evaluation of Cleaning Performance (3) Flight Deflection etc. | ○ | ○ | ○ | ○ | ○ | ○ | ○ | ○ | ○ |
| Evaluation of Ejection Properties (Solvent-Type Ink) | ○ | ○ | ○ | ○ | ○ | ○ | ○ | ○ | ○ |
| Evaluation of Ejection Properties (UV-Curable Ink) | ○ | ○ | ○ | ○ | ○ | ○ | ○ | ○ | ○ |
| Evaluation of Material Compatibility | ○ | ○ | ○ | ○ | ○ | ○ | ○ | ○ | ○ |
| Change of State of Mixture (Visual Observation) | Non | Non | Non | Non | Non | Non | Non | Non | Non |
| Change of State of Mixture (Rate of Change in Viscosity) | ◎ | ◎ | ◎ | ◎ | ○ | ◎ | ○ | ◎ | ○ |
| Evaluation of Ejection Properties of Mixture | ○ | ○ | ○ | ○ | ○ | ○ | ○ | ○ | ○ |

The "Non" means "not observed".

TABLE 4

| | Com. Ex. 1 | Com. Ex. 2 | Com. Ex. 3 | Com. Ex. 4 | Com. Ex. 5 | Com. Ex. 6 | Com. Ex. 7 |
|---|---|---|---|---|---|---|---|
| Evaluation of Cleaning Performance (1) | Δ | ○ | X | X | ○ | ○ | ○ |
| Evaluation of Cleaning Performance (2) Clogging | Non | Non | Observed | Observed | Non | Non | Non |
| Evaluation of Cleaning Performance (2) Flight Deflection etc. | Δ | Δ | X | X | X | Δ | Δ |
| Evaluation of Cleaning Performance (3) Clogging | Non | Observed | Observed | Observed | Non | Observed | Non |
| Evaluation of Cleaning Performance (3) Flight Deflection etc. | Δ | Δ | X | X | X | Δ | Δ |
| Evaluation of Ejection Properties (Solvent-Type Ink) | ○ | X | X | X | X | ○ | Δ |
| Evaluation of Ejection Properties (UV-Curable Ink) | Δ | X | X | X | Δ | X | Δ |
| Evaluation of Material Compatibility | X | X | X | X | ○ | ○ | ○ |

TABLE 4-continued

| | Com. Ex. 1 | Com. Ex. 2 | Com. Ex. 3 | Com. Ex. 4 | Com. Ex. 5 | Com. Ex. 6 | Com. Ex. 7 |
|---|---|---|---|---|---|---|---|
| Change of State of Mixture (Visual Observation) | Non | Non | Turned into gel | Observed | Non | Turned into gel | Non |
| Change of State of Mixture (Rate of Change in Viscosity) | Δ | Δ | X | X | Δ | X | Δ |
| Evaluation of Ejection Properties of Mixture | Δ | Δ | X | X | Δ | ○ | Δ |

As shown in Table 3, the maintenance liquids for inkjet printers according to the present invention obtained in Examples 1 to 9 using a glycol ethers or a glycol esters have an excellent ability to redissolve dried ink, that is, an excellent ability to clean printer components (Evaluation of Cleaning Performance (1)), and ejection properties after cleaning with each of the maintenance liquids of Examples 1 to 9 are also excellent (Evaluation of Cleaning Performance (2) and (3)). Further, it has been found that even when the maintenance liquid according to the present invention is directly supplied to a flow channel provided inside a printer, ejection properties are not adversely affected by cleaning due to the controlling of the amount of dissolved oxygen contained in the maintenance liquid, and therefore ejection can be stably performed even after cleaning (Evaluation of Ejection Properties). In addition, it has also been found that even when printer components such as a printer head and a tube for use as a flow channel are immersed in the maintenance liquid according to the present invention for a long period of time, discoloration, deterioration, and corrosion of these printer components do not occur (Evaluation of Material Compatibility).

On the other hand, as can be seen from Table 4, some or almost all of the maintenance liquids of Comparative Examples 1 to 7 have a poor ability to redissolve dried ink, that is, a poor ability to clean printer components, deteriorate ejection properties after cleaning of the inside of a printer therewith, corrode printer components (Evaluation of Material Compatibility), and cause ink instability when mixed with ink. That is, in Comparative Examples 1 to 7, no maintenance liquid exhibiting good results in all the evaluation tests was obtained.

The invention claimed is:

1. A maintenance liquid for inkjet printers, which comprises at least one of glycol ethers and glycol esters represented by the following general formulas (1) to (3), and 45 to 10 mg/L of dissolved oxygen:

$R_1CO(OR_2)_xOR_3$ General formula (1)

$R_4CO(OR_5)_yOCOR_6$ General formula (2)

$R_7(OR_8)_zOR_9$ General formula (3)

wherein $R_2$, $R_5$, and $R_8$ each independently represent an ethylene group or a propylene group, $R_1$, $R_3$, $R_4$, and $R_6$ each independently represent an alkyl group having 1 to 4 carbon atoms, $R_7$ and $R_9$ each independently represent a hydrogen atom or an alkyl group having 1 to 4 carbon atoms, and X, 1, and Z each independently represent an integer of 1 to 4, wherein said maintenance liquid does not contain water.

2. The maintenance liquid according to claim 1, which is used for an inkjet printer that performs printing by using an ink mainly comprising an organic solvent having a boiling point of 150° C. or higher.

3. The maintenance liquid according to claim 1, which is used for an inkjet printer that performs printing by using an ink mainly comprising a UV-curable monomer or a UV-curable oligomer.

4. The maintenance liquid according to claim 1, which comprises 80% by weight or more of the total amount of the at least one of glycol ethers and glycol esters represented by the general formulas (1) to (3).

5. The maintenance liquid according to claim 1, which further comprises a cyclic compound.

6. The maintenance liquid according to claim 5, wherein the cyclic compound is selected from the group consisting of cyclic ether solvents, cyclic ester solvents, cyclic amide solvents, cyclic ketone solvents, N-alkyl-oxazolidinone solvents, and N-alkyl-2-pyrrolidone.

7. The maintenance liquid according to claim 5, wherein mixing ratio between the at least one of glycol ethers and glycol esters represented by the general formulas (1) to (3) and the cyclic compound is 80 to 100:20 to 0 parts by weight.

8. The maintenance liquid according to claim 4, which further comprises 1 to 20% by weight of N-alkyl-oxazolidinone.

9. The maintenance liquid according to claim 1, wherein the maintenance liquid is obtained after adjusting an amount of dissolved oxygen.

10. A method for cleaning an inkjet printer, which comprises cleaning an inkjet printer using the maintenance liquid according to claim 1.

* * * * *